United States Patent [19]

Tieman

[11] 3,998,371

[45] Dec. 21, 1976

[54] SPRING EDGE FOR FURNITURE DECKS

[75] Inventor: Lloyd E. Tieman, Carthage, Mo.

[73] Assignee: Flex-O-Lators, Inc., Carthage, Mo.

[22] Filed: Mar. 31, 1976

[21] Appl. No.: 672,398

[52] U.S. Cl. ..... 267/102; 5/247; 297/452

[51] Int. Cl.[2] ..... F16F 3/00

[58] Field of Search ..... 5/247, 255, 260; 267/102; 297/452

[56] References Cited

UNITED STATES PATENTS

| | | | |
|---|---|---|---|
| 2,848,038 | 8/1958 | Bank et al. | 267/102 |
| 3,497,883 | 3/1970 | Arnold et al. | 297/452 X |
| 3,797,886 | 3/1974 | Griffiths | 297/452 |
| 3,888,473 | 6/1975 | Mandusky et al. | 267/102 |

*Primary Examiner*—James C. Mitchell
*Attorney, Agent, or Firm*—John A. Hamilton

[57] ABSTRACT

A spring edge for a furniture deck, the deck consisting of a wire fabric deck sheet resiliently supported over a rigid frame, the spring edge consisting of a series of vertically V-shaped spring elements distributed along the forward edge of the frame opening forwardly, with their apices being connected to the deck, each element consisting of a single strand of spring wire configurated to present a horizontally transverse top reach, downwardly and rearwardly inclined legs extending from each end of the top reach to the apex, horizontally transverse torsion legs extending from the lower end of each inclined leg, the torsion legs defining the apex of the element and being secured to the deck, and a forwardly extending bottom leg extending from the opposite ends of the torsion legs and being secured at their forward ends to the frame.

9 Claims, 4 Drawing Figures

SPRING EDGE FOR FURNITURE DECKS

This invention relates to new and useful improvements in spring edges for upholstered furniture.

In upholstered furniture such as sofas and couches wherein loose seat cushions are simply laid on and supported by a resilient substructure of "deck", it is customary to provide a raised edge along the forward edge of the deck. This "edge" has the functions both of preventing the cushions from sliding forwardly on the deck, and also of closing and concealing the vertical gap or open space which would otherwise appear between the deck and the lower front edge of the cushion, especially if the cushions have bulging or "crowned" upper and lower faces, as is usually the case. Also, the deck, while commonly resiliently yieldable, usually is mounted over a rigid frame, and has only thin padding, so that the forward deck edge, while padded, is usually very firm, creating a "hard edge" effect which is undesirable from the standpoint of maximum comfort. Edging strips consisting of lengths of plastic or rubber foam, usually of generally triangular cross-sectional contour, have heretofore been used, and do provide a padding over the forward frame edge, but are difficult to secure in place against the constantly repetitive shifting loads to which they are subjected in normal usage, and also do not provide the "depth" or distance of yieldability required for greatest comfort.

The desirability of a greater yieldability "depth" suggests the use of some type of edging utilizing springs rather than merely padding, and spring-type edges have been proposed, sometimes involving vertically V-shaped spring elements spaced along the forward edge of the deck, each having its apex secured to the deck, a lower leg extending forwardly and affixed at its forward end to the frame, and an upwardly and forwardly inclined leg carrying a transverse horizontal border wire defining the effective deck edge. In spring elements of this type, it is desirable that the element by formed of a single length of spring wire. Elements of this general type heretofore used have been subject to certain difficulties. If formed in a planar V-form, stress concentration at the apex causes work-hardening, crystallization, and early failure. If a horizontal transverse leg is inserted between the upper and lower legs, so that yielding of the upper leg is accomplished at least partially by torsional yielding of the horizontal transverse leg, early failure is reduced, but if the wire weight of the upper leg is sufficiently heavy to supply the desired torque support of the border wire, the torsion leg must be very long to have sufficient torsional yield, preferably as long or even longer than the upper leg, to prevent stresses from concentrating at the bends to cause early failure. If the torsion leg is sufficiently long, it must be secured to the deck along most of its length to guide the upper end of the upper leg in a proper vertical path as the edging yields in normal usage, and also to prevent the border wire supported by said upper legs from tilting or canting in a transverse vertical plane. Such inadequate support of the border wire can, in extended usage, cause a wavy, unattractive appearance.

Accordingly, the object of the present invention is the provision of a spring-type deck edging which overcomes all of the above enumerated shortcomings of prior devices, in that it is formed of a single length of spring wire of sufficient weight to support the border wire adequately, has torsion legs of sufficient length to avoid stress concentration at the wire bends, and has no tendency to cause the border wire to assume a wavy, non-straight configuration. Generally, this object is accomplished by spacing a series of vertically V-shaped spring elements along the forward edge of the deck, each element consisting of a single length of spring wire configurated to present a horizontal transverse top reach at the upper end of its upper leg, to which the border wire may be affixed, a rearwardly and downwarly inclined upper leg extending from each end of said top reach to the element apex, a horizontal, transverse torsion leg extending from the lower end of each of said upper legs, said torsion legs lying in close proximity to each other, and a lower leg extending forwardly from the opposite end of each torsion leg, and adapted to be secured at its forward end to the seat frame. The torison legs are secured to the deck in spaced relation from the frame, by means permitting both independent torsional yielding of said torsion legs, and forward and rearward sliding relative to the deck. The usual padding is applied over the surface defined by the upper legs of the spring elements.

Other objects are simplicity and economy of construction, and efficiency and dependability of operation.

With these objects in view, as well as other objects which will appear in the course of the specification, reference will be had to the accompanying drawing, wherein.

Figure 1:
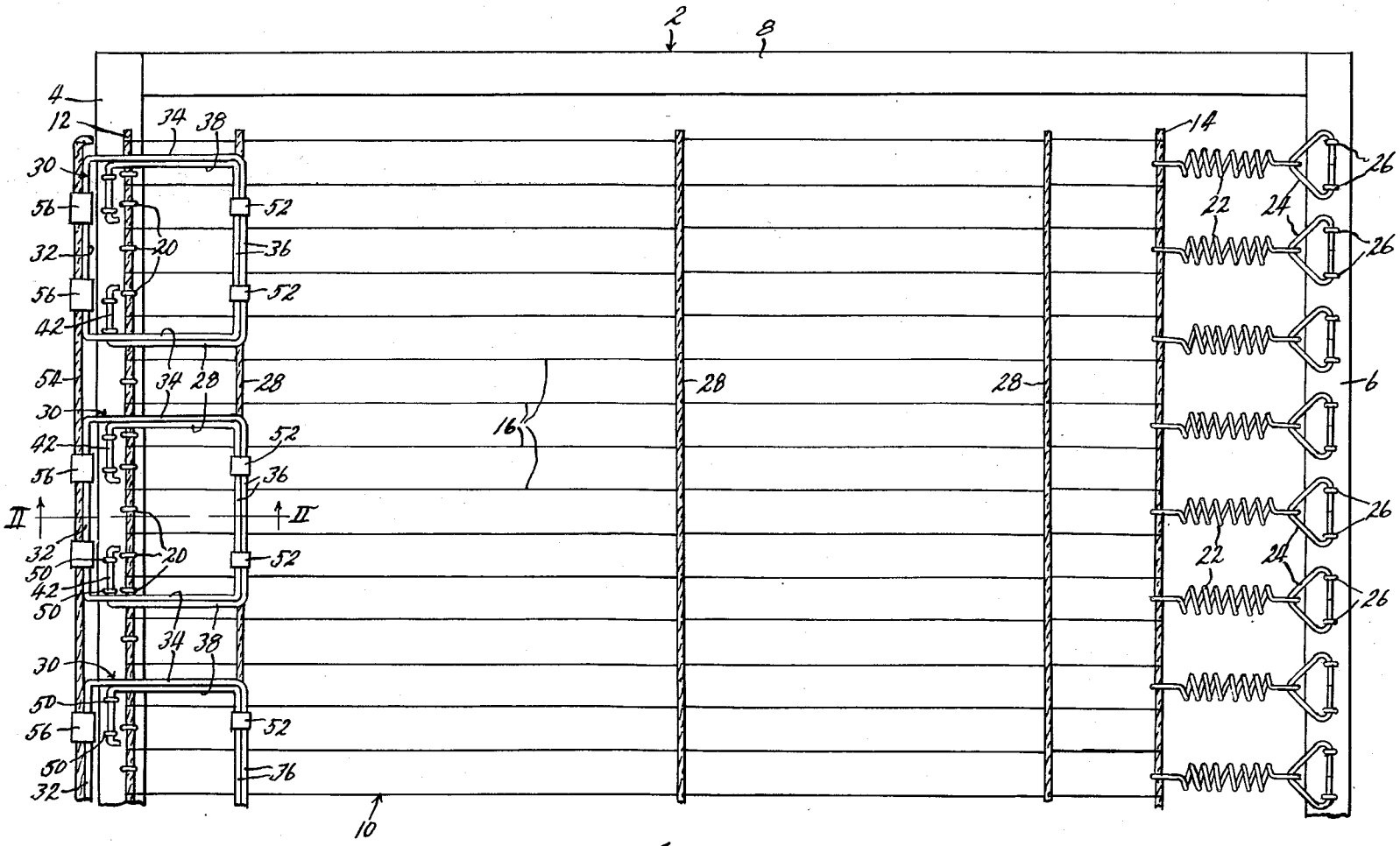
FIG. 1 is a fragmentary top plan view of a furniture deck including a spring edge construction embodying the present invention, with the padding and cover layers omitted.

Like reference numerals apply to similar parts throughout the several views, and the numberal 2 applies generally to the frame of a seat deck for upholstered furniture. Said frame, as shown, is of rigid rectangular form, including a front rail 4, rear rail 6, and side rails 8 (one shown). The frame may, of course, be of any desired width.

The deck platform sheet, indicated generally by the numeral 10, consists of a front strand 12 and a rear strand 14 which are parallel and extend transversely of the seat, and a series of parallel, closely spaced apart cross strands 16 extending forwardly and rearwardly between the front and rear strands and securely fastened thereto. Each of the front and rear strands consists of a spring steel wire core covered by a sheath of soft, indentable material such as twisted paper, and the corresponding end portion of each cross strand 16, said cross strands constituting spring steel wires, is "knotted" about said sheath, as best shown at 18 in FIG. 2. The sheath provides good purchase for the cross wires on the front and rear strands, and also prevents rubbing or grating "wire noises." Front strand 12 of the deck sheet overlies the top edge of front frame rail 4, and is affixed thereto by staples 20 distributed along the length thereof. Rear strand 14 is spaced forwardly of and parallel to rear frame rail 6, and is connected thereto by a series of helical springs 22 or other resiliently extensible members, hooked at their forward ends around strand 14, and each hooked at its rearward end into a triangular wire hanger 24 secured to rear frame rail 6 by staples 26. The size, strength and spacing of springs 22 is so selected as to impart the desired degree of resilient yieldability to deck sheet 10. Cross wires 16 may be connected together at spaced apart points along their lengths, whereby to render their spacing uniform, by intermediate strands 28, which may be formed of twisted paper or the like, without wire cores, pierced by each of cross wires 16 at its point of intersection therewith.

Figure 3:
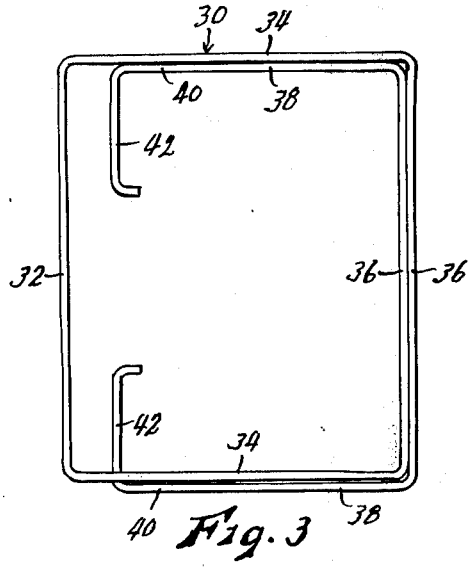
FIG. 3 is a top plan view of one of the spring elements, shown separated from all other elements.
Figure 4:
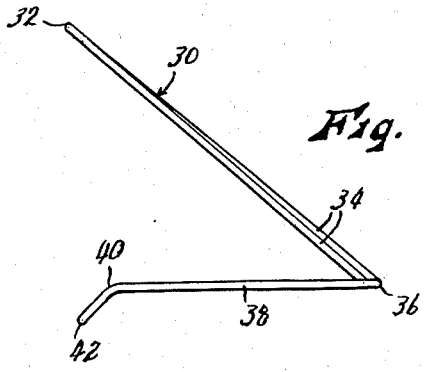
FIG. 4 is a side elevational view of the spring element as shown in FIG. 3.

The spring edge forming the subject matter of the present invention is disposed along the forward edge of frame 2, and consists primarily of a series of spring elements spaced along said forward frame edge, and each designated generally by the numeral 30. Each of said spring elements, as most clearly shown in FIGS. 3 and 4, is formed of a single length of spring steel wire, and is substantially V-shaped in a vertical plane. The central portion of the wire length constitutes a horizontal transversely extending top reach 32. Sloping downwardly and rearwardly from each end of top reach 32, to the apex of the V-formation, is a wire length forming an upper leg 34 of the element. At the lower end of each leg 34, the wire is bent to form a torsion leg 36, said torsion legs being substantially parallel to top reach 32, and extending oppositely from legs 34 so as to be substantially coextensive with top reach 32. Said torsion legs are disposed in close juxtaposition to each other, or against each other, and define the apex of the V-formation of the spring element. At the end of each torsion leg opposite from its associated upper leg 34, the wire is bent forwardly to form a lower leg 38 lying substantially in the vertical plane of the upper leg associated with the other of the torsion legs, and extending forwardly. Adjacent its forward end, each lower leg 38 is curved downwardly, as indicated at 40, and at its extreme forward end, the wire is bent horizontally inwardly to form a terminal leg 42 which is generally parallel to top reach 32.

Figure 2:
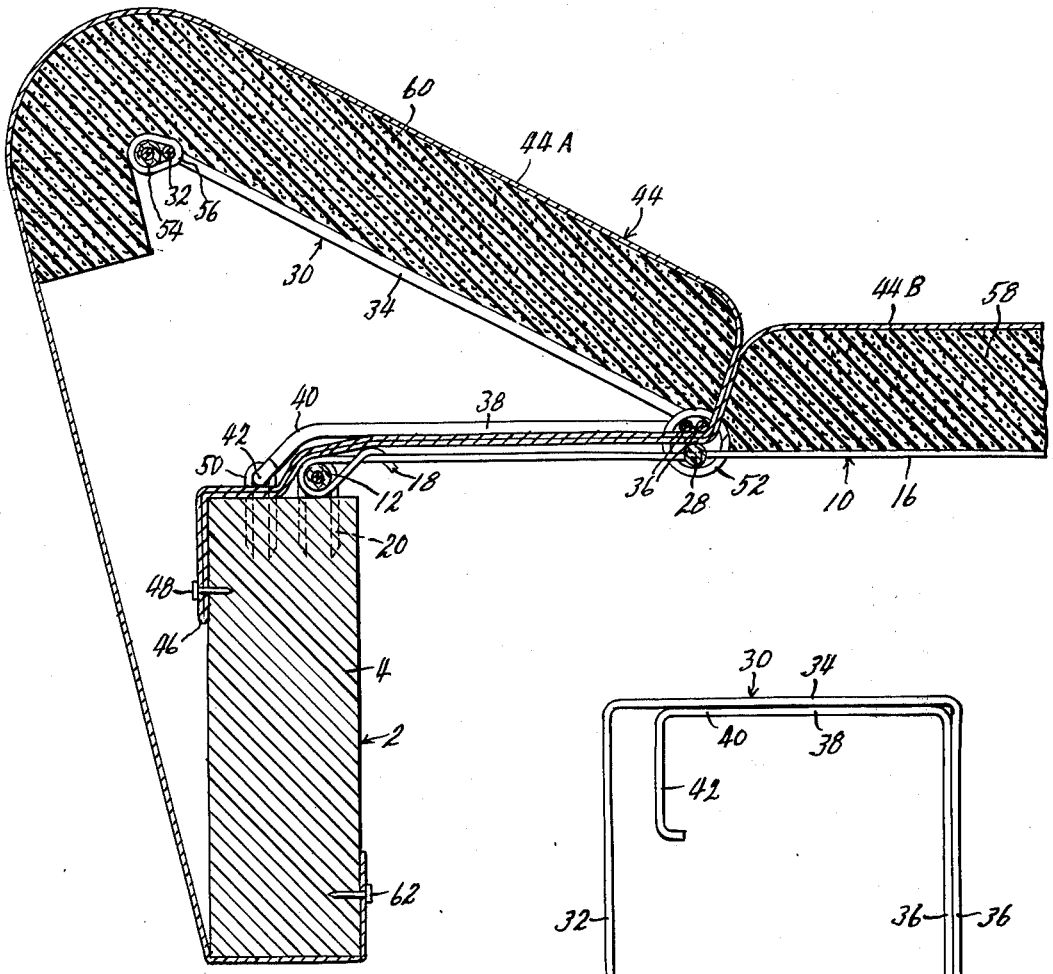
FIG. 2 is an enlarged, fragmentary sectional view taken on Line II—II of FIG. 1, with the padding and cover layers included.

In installation, after deck sheet 10 has been applied to frame 2 as shown and described, a cover layer 44 formed of natural or synthetic fabric or the like, and of a size capable of covering the entire top and vertical side edges of the seat, is folded along a line transverse to the seat, as indicated at 46 in FIG. 2, whereby to form layers 44A and 44B, and tacked to the front face of front frame rail 4 adjacent said fold, as indicated at 48. Both layers of the cover are then laid rearwardly over the top of deck sheet 10. Spring elements 30 are then spaced as desired along rail 2, and terminal legs 42 of said elements are secured to the top edge of rail 4, forwardly of front deck strand 12, by staples 50, said staples piercing both layers of cover 44. The curvatures 40 of lower legs 38 of the spring element permit them to extend rearwardly over strand 12. Torsion legs 36 at the apex of each spring element are then secured to the forwardmost intermediate strand 28 of the deck by clips, hog rings, or the like 52, which encircle both torsion legs as well as strand 28, and piercing both layers of cover sheet 44. At least two clips 52 should be used for each spring element, preferably adjacent the respectively opposite ends of the torsion legs, but of course should not be so tight as to bind the two torsion legs so tightly together as to prevent the relatively opposite torsional movements thereof which occur in normal usage. For reasons to appear, the attachment of the spring elements to the deck should be forwardly and rearwardly slidable, as is permitted by the slidability of strand 28 along cross wires 16 of the deck. Alternatively, torsion legs 36 could be hogringed directly to cross wires 16, with said hog-rings being slidable along wires 16. A border wire 54, which may be a paper-sheathed spring steel wire in the same manner as deck sheet strands 12 and 14, is then extended the full width of the seat at the upper ends of upper spring legs 34, and firmly secured to top reaches 32 of the springs by sheet metal clips 56. A layer 58 of padding material such as natural or synthetic foam or cotton felt is then laid over deck sheet 10 rearwardly of spring elements 30, and a similar layer 60 of padding material is laid over the top side of upper spring legs 34. Both layers of cover sheet 44 are led upwardly between the contiguous edges of padding layers 58 and 60. Finally, cover layer 44A is pulled forwardly over padding 60 and then downwardly in front of and under the lower edge of front frame rail 4, and tacked to the inner surface of said rail as at 60. This cover layer may be pulled to any desired degree of tension before it is tacked, thereby acting on a "tie-down" element providing any desired degree of pretensioning of the spring elements, and hence any desired degree of relative firmness or yieldability of the raised deck edge formed by said spring elements. Similarly, though not shown, cover layer 44B is drawn rearwardly over padding 58 and tacked to rear frame rail 6.

Thus it will be apparent that a spring deck edge assembly having several advantages has been produced. It is spring-supported, not merely padded, and hence provides a "depth" of yieldability conducive to a high degree of comfort. It is rigidly secured to the deck frame by staples 50 and hence cannot be disaligned or moved out of position in normal usage. It is simple and economical, both in original manufacture and in installation. The downward deflection of the elements, as most accurately reflected by downward deflection of border wire 54, is accomplished in large degree by twisting or torsional deformation of torsion legs 36 of the elements. This type of yield, by distributing the strain along a substantial length of wire, avoids much of the stress concentration and resultant early failure which would occur if the upper and lower legs of the elements laid in the same vertical plane and were connected by a sharp bend of the wire.

Nevertheless, the upper legs 34 of the elements must still flex vertically to some degree in the manner of cantilever springs, and must be sufficiently stiff to provide the desired degree of support for the border wire. It has been found that if the wire is sufficiently heavy and stiff to provide the required cantilever strength of upper legs 34, then the length of torsion legs 36 must be at least approximately equal in length to upper legs 34. Otherwise the torsion legs will be so stiffly resistant to twisting yield that dangerously high concentrations of stress will still occur at the wire bends at the ends of the torsion legs, and early failure may still result. Lengthening the torsion legs increases the leg length subject to torsion, and therefore decreases their resistance to twisting sufficiently to reduce stress concentration at the bends to a safely acceptable level. This approximate equality of length between the upper and torsion legs of the spring elements is present in the structure as shown, and is an important feature of the present invention.

With the torsion legs 36 as long as described, it becomes important that both torsion legs of each spring element be secured together in closely parallel relation along substantially their entire lengths, as is accomplished by clips 52. Otherwise, when the spring edge is loaded as in normal usage, the torsion legs would become misaligned, by separation or angularity thereof, and hence would provide irregular support for border wire 54, allowing it to be sinuously and irregularly deformed along its length. This would impart an untidy, irregular appearance to the seat which would be highly objectionable. Clips 52 maintain torsion legs 36 substantially parallel to top reach 32 and to terminal legs 42, so that top reach 32 is maintained generally parallel to the front edge of frame 2 at all times. Any sinuous malformation of the border wire, as described, is further prevented by the fact that the top reach 32 of each spring element, to which said border wire is affixed, is equally supported and positioned at both of its ends by the two upper legs 34 of the element.

Of course, clips 52 should not grip torsion legs 36 so tightly as to prevent the relatively opposite torsional yielding of said legs which occurs in usage. Otherwise, the advantages of the torsion action would be reduced or lost. Therefore, clips 52 engage torsion legs 36 only loosely. Also, it is important that whatever means connects torsion legs 36 to deck sheet 10 permits forward and rearward movement of said legs relative to said deck, since otherwise the spring elements would effectively shorten the front-to-rear span of the deck and interfere with the vertical yieldability of the deck. Such relative front-to-rear movement of torsion legs 36 relative to the deck, here shown as permitted by the slidability of strand 28, to which torsion legs 36 are attached, along wires 16 of the deck, although it could be provided by other means, renders the respective spring actions of the spring edge assembly, and of the deck, substantially independent of each other.

While I have shown and described a specific embodiment of my invention, it will be readily apparent that many minor changes of structure and operation could be made without departing from the spirit of the invention.

What I claim as new and desire to protect by Letters Patent is:

1. In combination with a furniture seat including a rigid frame and wire fabric deck sheet extending over said frame and being resiliently supported thereby for downward yieldability, a spring edge assembly extending across the forward edge of said seat and comprising:

a. A series of spring elements spaced across the forward edge of said frame, each of said elements being substantially V-shaped in a vertical plane opening forwardly, and formed of a single length of spring wire, said wire having a transversely horizontal top reach at the upper end of said V-formation, a downwardly and rearwardly sloping upper leg extending from each end of said top reach to the apex of said V-formation, a transversely horizontal torsion leg extending from the lower end of each of said upper legs, and defining the apex of said V-formation, and a lower leg extending forwardly from the end of each of said torsion legs not connected to the associated upper leg;

b. Means securing the forward ends of said lower legs to said frame; and c. Means securing said torsion legs to said deck sheet rearwardly of the forward edge of said deck sheet.

2. The structure as recited in claim 1 with the addition of a horizontally transverse resilient border strand extending transversely of said seat at the upper ends of the upper legs of said spring elements, and means securing said border wire to the top reach of each of said spring elements, as spaced apart points along the length of said top reach.

3. The structure as recited in claim 1 wherein the length of each of said torsion legs is at least approximately equal to the length of the upper leg from which it extends.

4. The structure as recited in claim 3 wherein said means securing each of said torsion legs to said deck sheet is operable to secure said torsion leg to said deck sheet at a pair of spaced apart points adjacent the respectively opposite ends of said torsion leg, whereby said torsion leg is maintained generally parallel to the top reach of said spring element.

5. The structure as recited in claim 4 wherein said means securing each of said torsion legs to said deck sheet encircles said torsion leg only loosely, whereby not to interfere with torsional deformation of said leg.

6. The structure as recited in claim 5 wherein said means securing each of said torsion legs to said deck sheet engages said deck sheet for free forward and rearward movement relative to said deck sheet.

7. The structure as recited in claim 1 wherein the length of said torsion legs is at least approximately equal to the length of said upper legs, wherein said torsion legs extend in respectively opposite directions from their associated upper legs, so as to overlap generally coextensively in close juxtaposition to each other, and wherein said means securing said torsion legs to said deck sheet constitutes a pair of ring clips disposed adjacent the respectively opposite ends of said overlapping portions of said torsion legs, said clips each loosely encircling said overlapping portions of said torsion legs and an element of said deck sheet.

8. The structure as recited in claim 7 wherein said ring clips are freely movable forwardly and rearwardly relative to said deck sheet.

9. The structure as recited in claim 7 wherein said deck sheet includes forwardly and rearwardly extending parallel wires, and a transverse strand pierced by said wires so as to be forwardly and rearwardly slidable on said wires, said ring clips encircling said transverse strand.

* * * * *